US005520500A

United States Patent [19]

McIlwain et al.

[11] Patent Number: 5,520,500

[45] Date of Patent: *May 28, 1996

[54] METHOD AND APPARATUS FOR TILTING A SKID STEER LOADER CAB

[75] Inventors: Irwin D. McIlwain, Lancaster; Robert R. Todd, Leola; Edward H. Priepke, Lancaster, all of Pa.

[73] Assignee: New Holland North America, Inc., New Holland, Pa.

[ * ] Notice: The term of this patent shall not extend beyond the expiration date of Pat. No. 5,518,358.

[21] Appl. No.: 293,946

[22] Filed: Aug. 24, 1994

[51] Int. Cl.[6] ..... E02F 9/00

[52] U.S. Cl. ..... 414/685; 180/89.19

[58] Field of Search ..... 414/685; 180/89.14, 180/89.15, 89.19; 296/190

[56] References Cited

U.S. PATENT DOCUMENTS

| | | | |
|---|---|---|---|
| 3,215,292 | 11/1965 | Halls . | |
| 4,116,484 | 9/1978 | Mangless | 180/89.14 X |
| 4,388,038 | 6/1983 | Freitag | 414/685 |
| 4,401,179 | 8/1983 | Anderson | 180/89.14 |
| 4,682,666 | 7/1987 | Klee et al. | 180/89.13 |
| 4,811,983 | 3/1989 | Watts et al. | 296/190 |
| 5,042,602 | 8/1991 | Nakatani et al. | 180/68.1 |

*Primary Examiner*—Donald W. Underwood

*Attorney, Agent, or Firm*—Frank A. Seemar; Larry W. Miller

[57] ABSTRACT

A skid steer loader having a main frame including a compartment in which an engine, hydraulic drive components and other elements are contained. A cab is mounted above the compartment on the main frame with load bearing side walls extending upwardly to define an operator control area therebetween. Pivotally mounted on such walls is a boom structure including a pair of arms and a mounting assembly. An engine is operatively associated with the boom structure for raising and lowering each of the pair of arms along a generally vertical path adjacent a corresponding load bearing side wall to which it is coupled by the mounting assembly. The cab is mounted on the frame for conjoint movement of the side walls and the boom structure from an operative position to a remote position to provide unobstructed access to the compartment while maintaining the drive and transmission componentry in an operational mode.

9 Claims, 5 Drawing Sheets

13
30
31
76
26
36
38
72
16
17
12
21
20
35
58
43
57
28
24
61
25
45
46
17
14
44
22
75
73
60
51
50
11
64
65
52
47
48
67
27
34
53
42
54

METHOD AND APPARATUS FOR TILTING A SKID STEER LOADER CAB

FIELD OF THE INVENTION

The present invention relates generally to front end loaders and more particularly to the method and apparatus for tilting a skid steer loader cab by using a tool kit for tilting the cab together with the boom assembly to provide access to internal components of the loader that would be otherwise blocked by the cab or boom assembly.

BACKGROUND OF THE INVENTION

Over the years skid steer loaders have been known as agile, compact vehicles with a high degree of maneuverability and a wide range of applications in the agricultural, industrial and construction fields. These vehicles usually include an engine, a boom assembly and an operators compartment mounted on a frame supported by four ground supporting wheels. Coupled to the engine are a main drive system and a lift system for the boom assembly. The vehicle is maneuvered by driving the wheels on one side at a different speed and/or in a different direction from those on the other side resulting in a turning motion, the severity of which is determined by the relative speeds.

Typically the engine, which is rear mounted for counterbalancing effect, drives a pair of hydrostatic pumps coupled to left and right mounted hydrostatic motors. Wheels on the left and right sides of the vehicle are driven by the left and right mounted motors through gears, chains and sprockets. Typically, motion is controlled by an operator seated within the operators compartment by actuating a pair of control levers which are linked to the pumps. The extent to which each lever is moved in a forward direction from a neutral position controls the amount of fluid supplied in a forward direction to its respective motor, and therefore the speed at which the wheels on that side of the vehicle will rotate. Similarly, the extent to which a lever is moved in the reverse direction from the neutral position will control the speed at which the associated wheels rotate in the reverse direction.

As mentioned above, skid steer loaders include a boom assembly. This assembly generally comprises a pair of lift arms pivotally mounted to the main frame, or a support frame extending upwardly from the main frame as shown in U.S. Pat. No. 5,042,602, issued Aug. 27, 1991 in the name of Toshinori Nakatani, et al. Attachments are usually mounted to the front of the lift arms.

A separate hydraulic system is used to actuate the boom assembly via hydraulic lift cylinders which drive the lift arms. This system is also used to actuate one or two tilt cylinders which pivot the attachment with respect to the lift arms. Typically, a pair of foot pedals in the front of the operator compartment control the flow of hydraulic fluid from an implement pump to the lift and tilt cylinders.

In addition to material handling buckets, various other attachments such as snow blowers, trenchers, tree spades and augers which include their own hydraulic motors are commonly mounted to the boom assembly. An auxiliary hydraulic system is used to control the flow of hydraulic fluid between the implement pump and the hydraulic motor of the front mounted attachment. It is common in prior art systems for the flow of hydraulic fluid to the motor to be controlled by an auxiliary spool valve through actuation of a handle on one of the control levers. The handle is normally biased to a neutral position. Pushing the handle in one direction strokes the auxiliary valve in a first direction, thereby causing hydraulic fluid to flow to the front mounted attachment in a first direction. Pushing the handle in the opposite direction strokes the auxiliary valve so as to supply fluid in a reverse direction.

There is a need in skid steer loaders, as in any vehicle, for convenient access to the transmission compartment, the engine, various drive components, etc., for servicing and repair. However, the compactness of skid steer loaders along with the inherent obstructions to access caused by the boom and boom mounting structure have given rise to unique problems that heretofore have not been satisfactorily addressed. For example, it is commonly practiced in vehicles such as trucks and tractors to pivotally mount the cab on the chassis but this does not embrace the problem of access to a vehicle such as a skid steer loader which by its nature includes structure not existing on conventional tractors. U.S. Pat. No. 4,116,484, issued Sep. 26, 1978 in the name of Vernon W. Mangless is illustrative of a tiltable tractor cab.

Also disclosed in the prior art is the general concept of providing a tiltable cab on a skid steer loader. In this regard, U.S. Pat. No. 4,401,179, issued Aug. 30, 1983 in the name of Robert M. Anderson, No. 5,042,602, issued Aug. 27, 1991 in the name of Toshinori Nakatani, et al, and U.S. Pat. No. 4,811,983, issued Mar. 14, 1989 in the name of Verne C. Watts, et al all show skid steer loaders with tiltable cabs and stationary boom supports on which boom arms are mounted.

It is also known in the prior art to provide skid steer loaders with means for moving the operators cab via non pivoting means. For example in the loader shown in U.S. Pat. No. 4,682,666, issued Jul. 28, 1987 in the name of Maurice Klee, et al, the cab is horizontally translatable.

In all known prior art apparatus of which applicants are aware there is no simple, convenient system for gaining access to the drive and transmission components. Even in those cases where skid steer loader cabs are pivoted or moved away from the frame there still exists other cumbersome obstructions such as the boom arms and the boom arm mounting structure in the form of an adjacent upright frame assembly. These obstructions have been contended with by either accepting their unwanted presence and working around them or in some instances they are removed prior to service and maintenance tasks, which removal is obviously an arduous and time consuming undertaking.

SUMMARY OF THE INVENTION

An important object of the present invention is to provide the method and apparatus for tilting skid steer loader cab and boom apparatus to provide simple unencumbered access to the drive and transmission area for convenient servicing and maintenance tasks.

In pursuance of this and other important objects the present invention is directed to an improvement to a skid steer loader comprising a main frame including a compartment in which transmission and drive components are contained, a cab, mounted in its operative position above the compartment on the main frame, load bearing side walls extending upwardly from the main frame to define an operators control area, a boom structure comprising a pair of arms supported by the load bearing side walls and a mounting assembly for operatively coupling the pair of arms to the side walls, power means comprising an engine operatively associated with the boom structure for raising and lowering each of such pair of arms along a generally vertical path adjacent its corresponding load bearing side wall to which it is coupled, and means for mounting the cab on the frame for conjoint movement with the boom structure from an operative position to a remote position such that the top of the compartment is unobstructed. More specifically, the present invention contemplates an improvement comprising a tool kit for effecting the conjoint movement of the cab and the boom assembly. The kit comprises a jack assembly, an upper bracket for securing one end of the jack assembly to the cab, and a lower bracket for securing the other end of the jack assembly to the main frame, wherein the jack assembly includes expandable and contractible means for rotating the cab and boom assembly in one direction when the jack assembly is contracted to remove the cab from the top of the compartment to provide unobstructed access thereto.

The present invention further contemplates a method of moving the cab and boom structure from its operative position to its remote position, wherein the method comprises the steps of raising the boom to a predetermined level, affixing the boom to such predetermined level, and conjointly pivoting the cab and boom structure so affixed from said operative position to the remote position to provide unobstructed access to the compartment.

The foregoing and other objects, features and advantages of the invention will appear more fully hereinafter from a consideration of the detailed description which follows, in conjunction with the accompanying sheets of drawings wherein one principal embodiment of the present invention is illustrated by way of example. It is to be expressly understood, however, that the drawings are for illustrative purposes and are not to be construed as defining the limits of the invention.

DESCRIPTION OF THE PREFERRED EMBODIMENT

Figure 1:
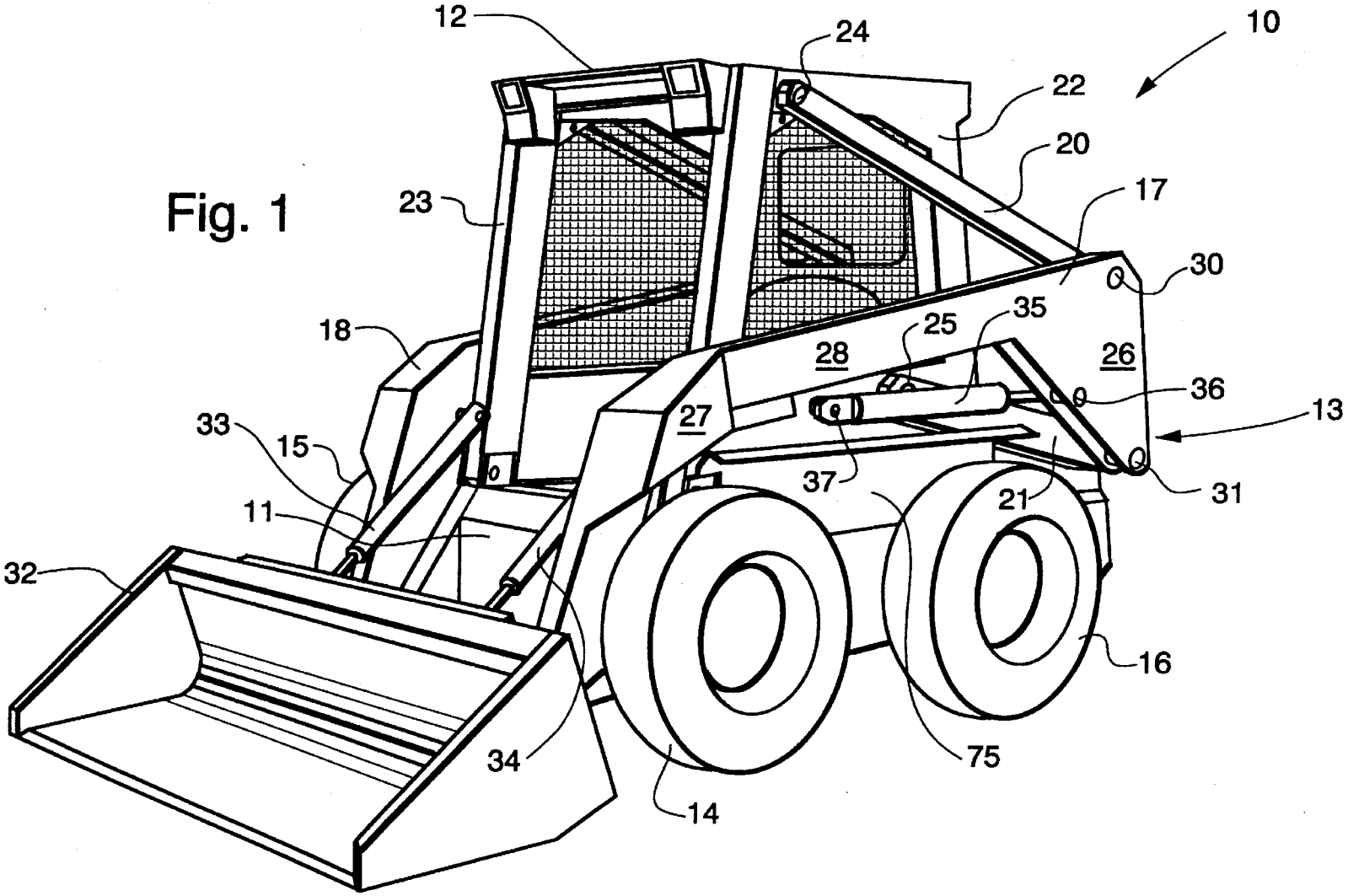
FIG. 1 is a perspective view taken from the left front of a prior art skid steer loader on which the present invention is readily carried out.

Referring now to the drawings for a more detailed description of the present invention, FIG. 1 shows a skid steer loader 10, which utilizes a four bar linkage system of the type generally disclosed in U.S. Pat. No. 3,215,292, issued Nov. 2, 1965 in the name of L. M. Halls, hereby incorporated by reference. Loader 10 includes a main frame 11, a cab 12 and a boom assembly 13, all of which are supported by a pair of front wheels 14, 15 and a pair of rear wheels 16 (only one shown) mounted on axles (not shown) extending from main frame 11.

A pair of lift arms 17, 18 are swingably mounted via upper links 20 and lower links 21 to load supporting side walls 22, 23 of cab 12 via pivots 24 and 25, respectively. For convenience, because the elements on one side of skid steer loader 10 are paired with similar elements on the other side, only one side of the boom assembly mounting structure will be described in most instances in the following description. Each lift arm, comprising a rear portion 26, a forward portion 27 and an intermediate integral portion 28, accommodates upper link 20 and lower link 21 at pivots 30 and 31, respectively, in the rear portion 26 thereof.

Pivotally mounted to the forward portion 27 of lift arms 17, 18 is an attachment such as a material handling bucket 32 which is rotated with respect to the lift arms in a known manner by means of hydraulic tilt cylinders 33, 34. The entire boom assembly 13 and bucket 32 are raised and lowered by means of a pair of hydraulic cylinders 35, each of which is pivotally mounted to the rear portion 26 of lift arm 17 at a pivot 36 and side wall 22 at pivot 37.

Figure 2:
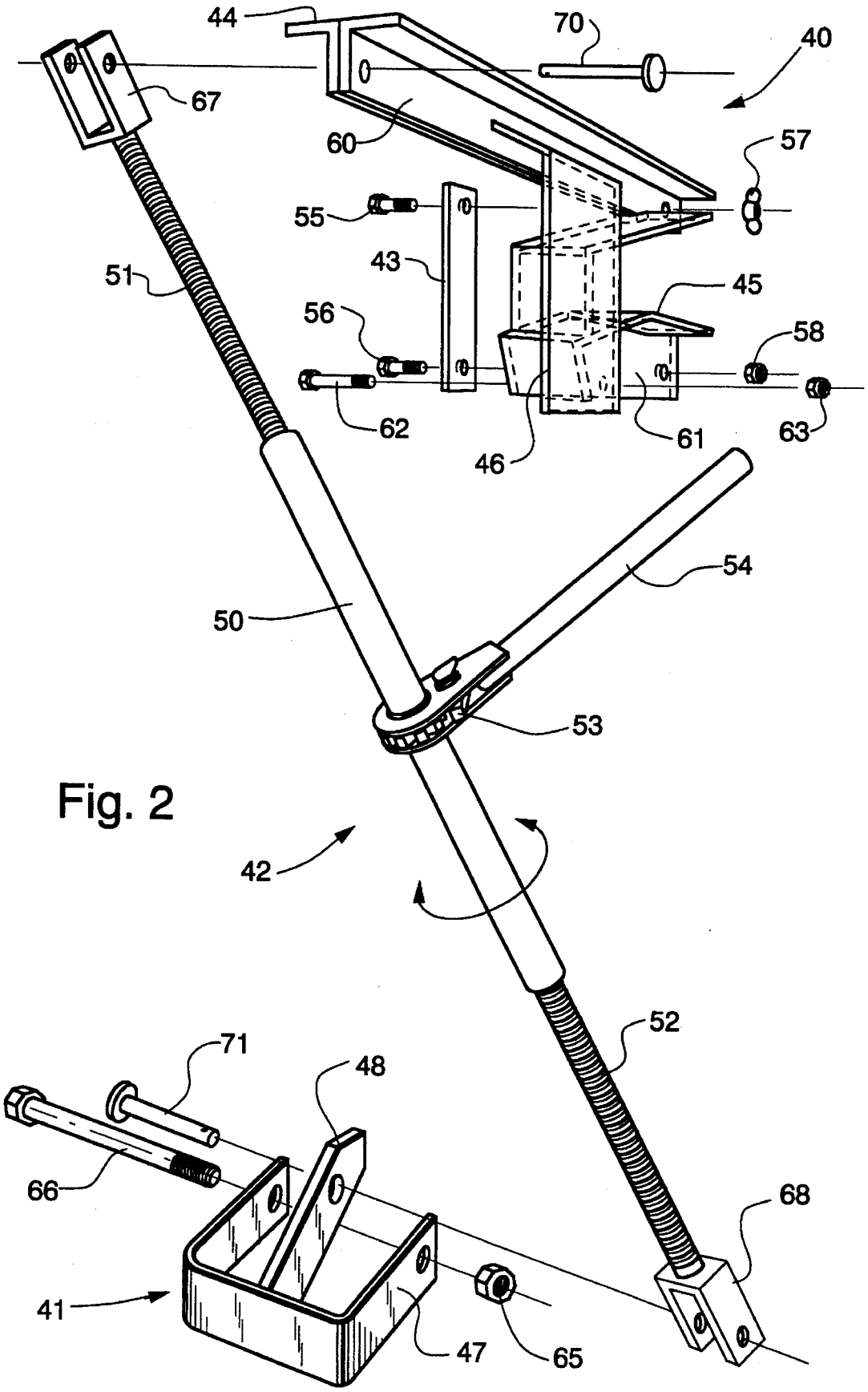
FIG. 2 is an exploded view of key elements used in carrying out the present invention.
Figure 3:
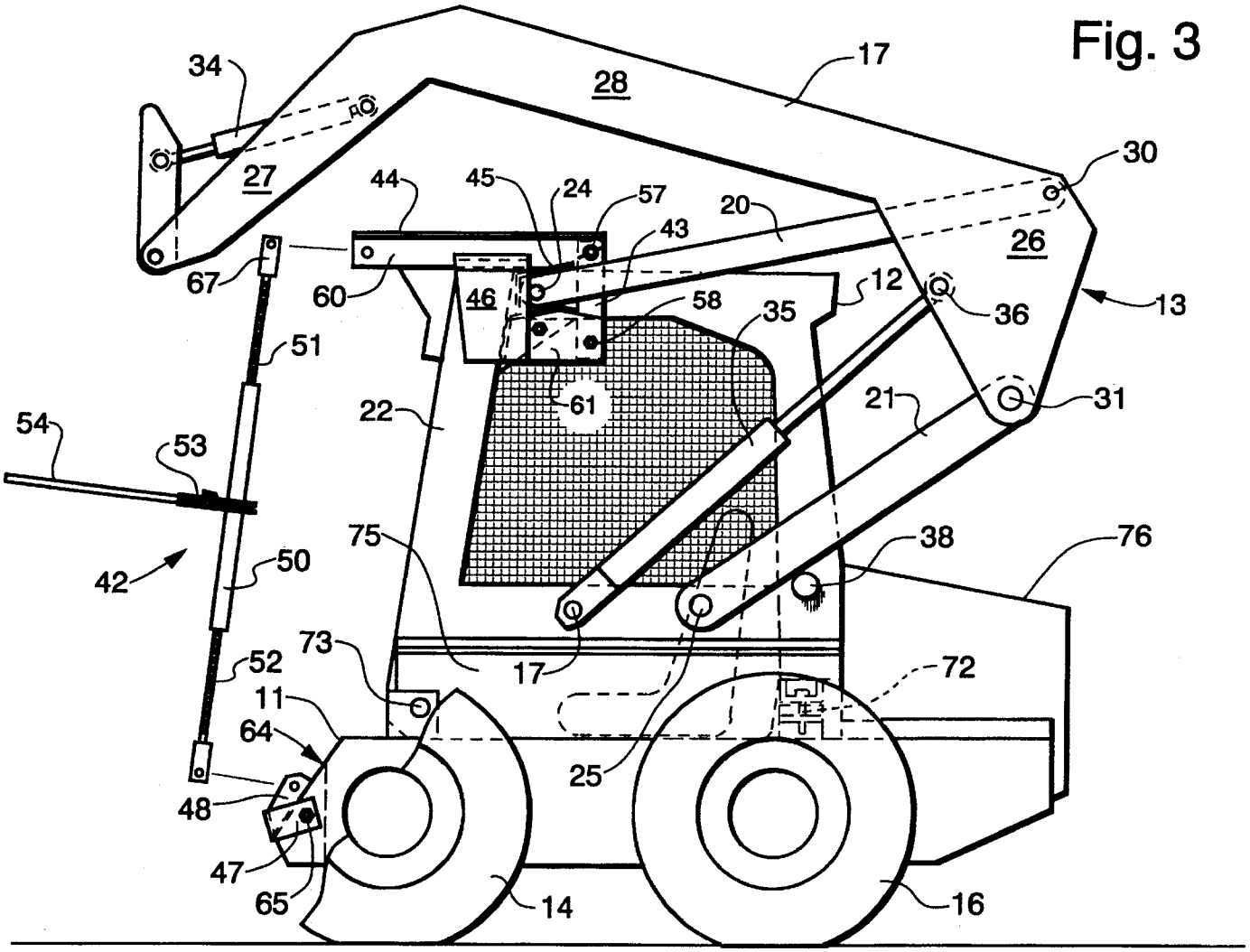
FIG. 3 is a side elevational view of the relationship of the elements shown in FIG. 2 to the loader with the boom raised and the bucket removed.

Now turning to FIGS. 2 and 3, the tilting kit used in carrying out the present invention is shown in exploded fashion in FIG. 2 whereas in FIG. 3 the kit is shown in its operative position with respect to skid steer loader 10 with the bucket removed and the boom assembly raised to a predetermined position at which boom lock elements 38 are employed. In such operative position loader 10 employs a boom locking system of the type disclosed in U.S. Pat. No. 4,388,038, issued Jun. 14, 1983 in the name of Lonny R. Freitag, hereby incorporated by reference. More specifically, the kit comprises an upper bracket array consisting of jack support assembly 40, a lower bracket array consisting of jack support assembly 41 and an operative coupling between the bracket arrays consisting of a jack assembly 42, the latter of which is shown juxtaposed to its operative position in FIG. 3.

As shown in FIG. 2, upper jack support assembly 40 comprises a retaining plate 43 and a support arm 44. A link keeper 45 and an integral vertical support member 46 are affixed to support arm 44 for securement purposes. Lower support assembly 41 consists of a U shaped member 47 and an integral support arm 48 extending upwardly at the angle shown to conform to the slope of the main frame surface to which it is attached, as discussed below. Completing the major elements of the tilting kit is jack assembly 42, having a turnbuckle 50 with an upper screw 51 and a lower screw 52 operatively associated therewith in a conventional manner. A bidirectional rachet 53 with a jack handle 54 is provided for rotating turnbuckle 50 to retract or extend in concert upper screw 51 and lower screw 52.

Figure 4:
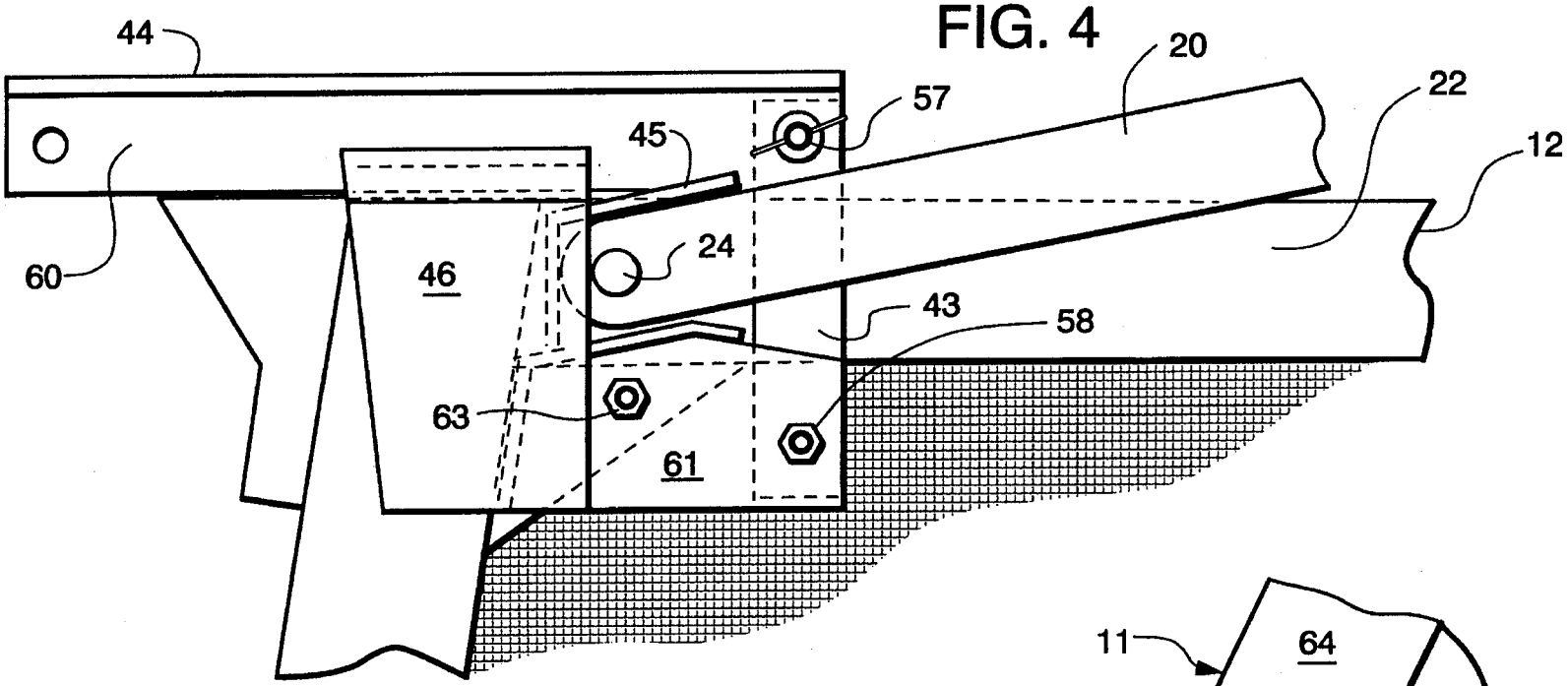
FIG. 4 is an enlarged partial side elevational view showing the top left front corner area of the cab.

Upper jack support assembly 40 is attached to the front right portion of the left side wall 22 (see FIGS. 3 and 4) such that support arm 44 is cantilevered out as shown with the pivoted end of upper link 20 encompassed by link keeper 45. The assembly is secured in place via bolts 55, 56 and nuts 57, 58 extending through retainer plate 43 on the inside of sidewall 22 and support flange 60 of upper support arm 44 and keeper flange 61 on link keeper 45. Another bolt 62 and nut 63 combination also extends through flange 61. It should be noted that flange 61 is configured to conform to the adjacent edges of sidewall 22 for added rigidity.

Figure 5:
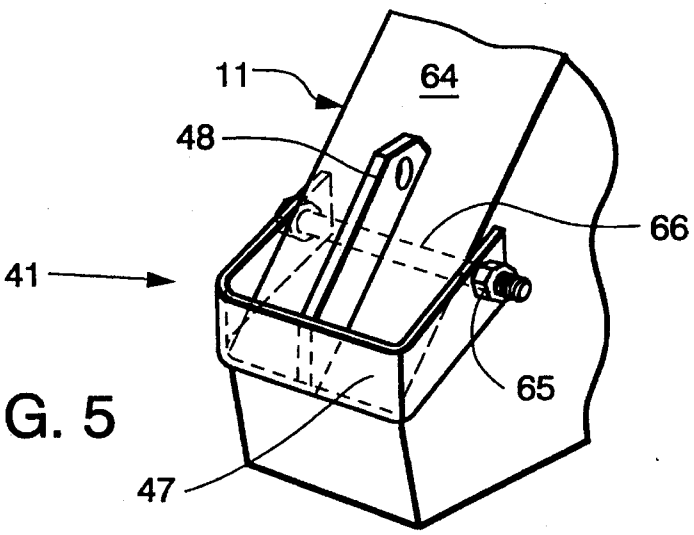
FIG. 5 is an enlarged perspective view of the lower support bracket.

Turning to FIG. 5, lower jack support assembly 41 is shown in its operative position affixed in the vicinity of an inclined surface portion 64 of main frame 11. U shaped member 47 is attached via nut 65 and bolt 66 such that integral support arm 48 is contiguous with and supported on inclined surface portion 64.

Figure 6:
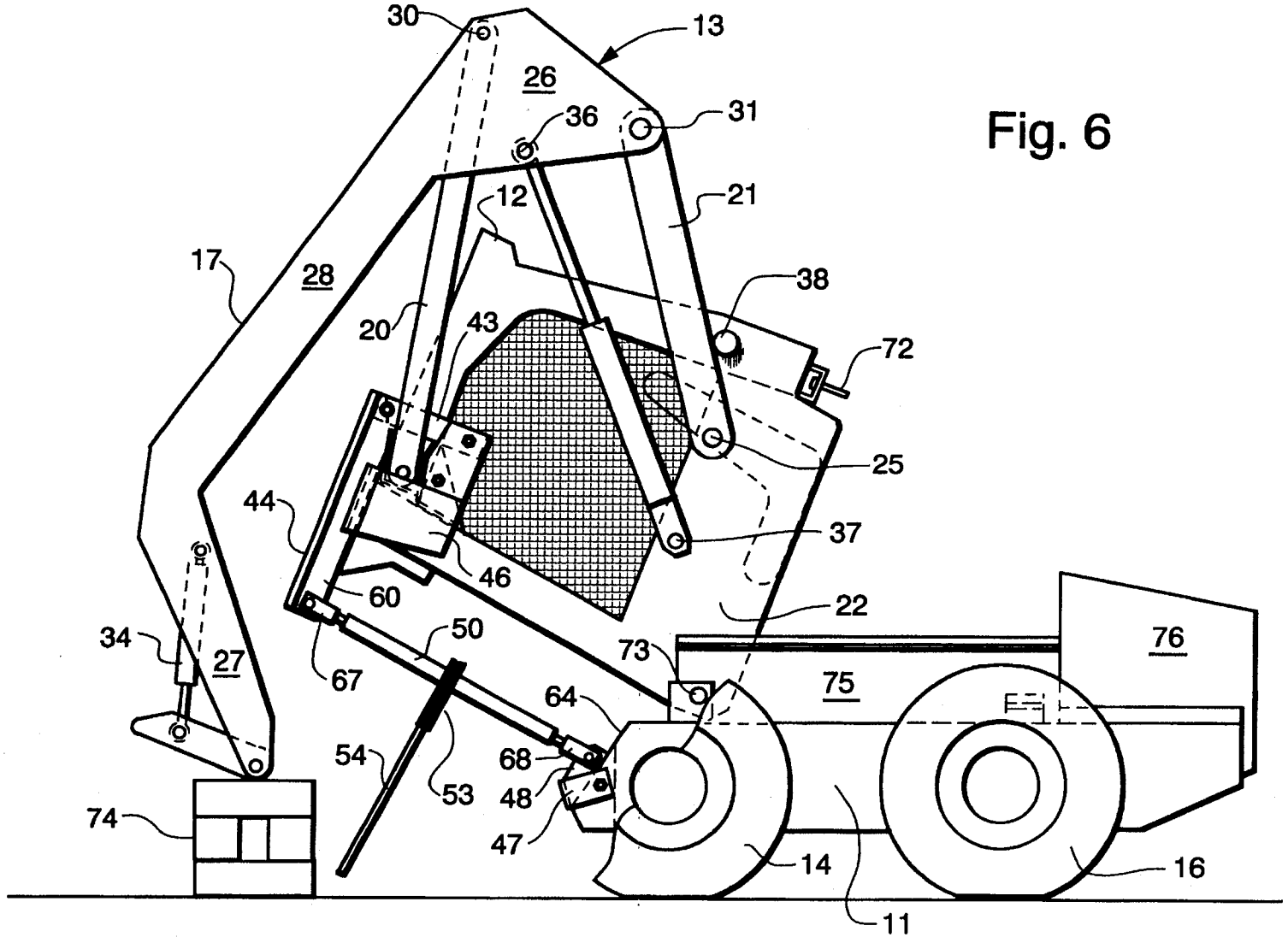
FIG. 6 is a side elevational view of the loader with the cab and boom tilted in the access position.

In operation, the attachment, such as bucket 32, is typically removed and the boom assembly is raised to the position shown in FIG. 3 with lower link 21 resting on boom lock element 38. In this position upper link 20 is maintained in the angular position shown relative to sidewall 22 which permits upper jack support assembly 40 to be secured in the position shown in FIG. 3 such that the end of link 20 is nested in link keeper 45. Lower jack support assembly 41 is then attached as shown in FIGS. 3 and 5 which permits jack assembly 42 to be secured between support flange 60 on support arm 44 and integral support arm 48 via clevises 67, 68 on jack assembly 42 and pins 70, 71. Fenders 75 and the various means securing the rear of the cab, such as, for example, bolt 72, are then removed and turnbuckle 50 is rotated in the direction that retracts upper and lower screws 51, 52 which thereby pivots the cab and boom assembly conjointly around pivotal securement means 73 at the front of the cab. Rotation of turnbuckle 50 continues until the boom assembly and cab reach the position shown in FIG. 6 with the boom assembly resting on support 74. The main frame compartment which houses various drive and transmission components is then completely accessible from the top for service and repair functions. As mentioned above, fenders 75, shown in their operative position in FIG. 6, will have been removed to facilitate such access.

For further convenience, the front and rear wheels, engine side panels, etc., can also be removed if necessary. By leaving the entire cab and boom structure pivoted to a position remote from its operative position but still adjacent the compartment, it is contemplated that the coupling for all electrical and hydraulic componentry, i.e., wire harnesses, hoses, cables, etc., will be of sufficient length and of such routing to permit the loader to be maintained in its operative state with the cab and boom assembly in the FIG. 6 position. This further simplifies the transition operation and makes it possible to run the engine and transmission during and immediately after servicing. Of course, this is only possible under conditions where the wheels have been removed and the frame is supported on appropriate blocks. It should also be noted that by leaving all electrical and hydraulic componentry coupled prevents the possibility of mistakes during reassembly, which significantly enhances the reliability of the loader.

In conventional skid steer loaders the engine is mounted in the rear in an engine compartment 76 for convenience of routine service with the cab attached and, just as important, for counterbalancing the boom and attachments during lifting as well as other working operations. The engine also serves such counterbalancing function when in the tilted mode for servicing and maintenance that does not normally require removal of the engine, but in those instances where removal of the engine is desirable support 74 prevents instability and thereby obviates unwanted tilting past the position shown.

When servicing and maintenance are completed the loader is easily returned to its operative condition. Because all hydraulic and electrical connections have been maintained as noted above, this is quickly accomplished by merely reversing the above described steps and removing the tilting kit.

Of the many implicit and explicit advantages of the present invention one of the most important is the provision of unobstructed access to the engine and various drive components of a skid steer loader type vehicle for convenient servicing and repair without unnecessarily disconnecting the functional systems. Further, in view of the simplicity of the apparatus, there is inherently a reduction in the required time for gaining access which improves the productivity and efficiency of the servicing organization. Still further, the unobstructed access enhances significantly the ability to reduce the actual time required for the servicing and repair tasks.

While preferred structure in which the principles of the present invention are shown and described above, it is to be understood that the invention is not limited to such structure, but that, in fact, widely different means of varying scope and configuration may be employed in the practice of the invention.

Having thus described the invention, what is claimed is:

1. In a skid steer loader comprising a main frame including a compartment in which transmission and drive components are contained, a cab mounted in its operative position above said compartment on said main frame, said cab including load bearing side walls extending upwardly from said main frame to define an operators control area therebetween, a boom structure comprising a pair of arms supported by said load bearing side walls and a mounting assembly for operatively coupling said pair of arms to said side walls, power means comprising actuators connected between said side walls and said boom structure for raising and lowering each of said pair of arms along a generally vertical path adjacent its corresponding load bearing side wall to which it is coupled, and means for mounting said cab on said frame for conjoint movement with said boom structure from an operative position to a remote position such that the top of said compartment is unobstructed, the improvement comprising a tool kit for effecting said conjoint movement of said cab and said boom assembly, said kit comprising a jack assembly, an upper bracket for securing one end of said jack assembly to said cab, and a lower bracket for securing the other end of said jack assembly to said main frame, said jack assembly including expandable and contractible means for rotating said cab and boom assembly in one direction when the jack assembly is contracted to remove the cab from the top of said compartment to provide unobstructed access thereto.

2. In a skid steer loader as set forth in claim 1 wherein said means for mounting include pivot means about which said cab and boom assembly are rotated, and wherein the center of gravity of the cab and boom assembly passes through a point above said pivot means when the cab and boom assembly are being conjointly moved between the operative position and the remote position.

3. In a skid steer loader as set forth in claim 2 wherein said upper bracket is attached to an upper portion of said cab and said lower bracket is attached to said main frame.

4. In a skid steer loader as set forth in claim 3 wherein said expandable and contractible means comprises a screw jack operating in compression under conditions where said cab and boom structure has been moved from the operative position to a position where the center of gravity is past the point above said pivot means.

5. In a skid steer loader comprising a main frame including a compartment in which transmission and drive components are contained, a cab mounted in its operative position above said compartment on said main frame, said cab including load bearing side walls extending upwardly from said main frame to define an operators control area therebetween, a boom structure comprising a pair of arms supported by said load bearing side walls and a mounting assembly for operatively coupling said pair of arms to said side walls, power means comprising actuators connected between said side walls and said boom structure for raising and lowering each of said pair of arms along a generally vertical path adjacent its corresponding load bearing side wall to which it is coupled, and means for mounting said cab on said frame for conjoint movement with said boom structure from an operative position to a remote position such that the top of said compartment is unobstructed, the improvement comprising a method of moving said cab and boom structure from its operative position to its remote position, said method comprising raising said boom to a predetermined level, maintaining said boom at said predetermined level, and conjointly pivoting said cab and said boom structure so maintained from said operative position to said remote position to provide unobstructed access to said compartment.

6. In a skid steer loader as set forth in claim 5 wherein said method further includes resting said boom structure on a stand when in said remote position.

7. In a skid steer loader as set forth in claim 5 wherein said maintaining step further includes resting said boom structure on elements extending from said walls.

8. In a skid steer loader as set forth in claim 5 wherein said means for mounting said cab further comprises pivot means on said main frame, and said pivoting step further comprises conjointly pivoting said cab and boom structure about said pivot means.

9. In a skid steer loader as set forth in claim 8 wherein said maintaining step further includes resting said boom structure on elements extending from said walls.

* * * * *